US008462101B2

(12) United States Patent
Han et al.

(10) Patent No.: US 8,462,101 B2
(45) Date of Patent: Jun. 11, 2013

(54) APPARATUS FOR AND METHOD OF CONTROLLING BACKLIGHT OF DISPLAY PANEL IN CAMERA SYSTEM

(75) Inventors: Bing Han, Henan (CN); Paul Gallagher, San Jose, CA (US); Yun-tae Lee, Seoul (KR); Joon-seo Yim, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 374 days.

(21) Appl. No.: 12/835,122

(22) Filed: Jul. 13, 2010

(65) Prior Publication Data

US 2011/0007103 A1 Jan. 13, 2011

(30) Foreign Application Priority Data

Jul. 13, 2009 (KR) ..... 10-2009-0063601

(51) Int. Cl.
*G09G 5/10* (2006.01)

(52) U.S. Cl.
USPC ..... 345/102; 345/88; 345/207; 345/211; 345/690; 345/691; 348/234; 348/238; 348/255; 362/97.2

(58) Field of Classification Search
USPC ..... 345/87, 102, 690–691, 211, 83, 88, 345/207; 348/234–236, 229.1–130.1, 254–256, 348/362; 362/97.1–97.3
See application file for complete search history.

(56) References Cited

U.S. PATENT DOCUMENTS

| | | | | |
|---|---|---|---|---|
| 7,403,227 | B2 | 7/2008 | Schinner | |
| 2005/0041139 | A1* | 2/2005 | Lowles | 348/362 |
| 2005/0282561 | A1 | 12/2005 | Wu | |
| 2006/0249660 | A1* | 11/2006 | Huang et al. | 250/214 AL |
| 2007/0291989 | A1* | 12/2007 | Ito et al. | 382/103 |
| 2008/0158113 | A1 | 7/2008 | Ozawa | |
| 2010/0013748 | A1* | 1/2010 | Cok et al. | 345/83 |
| 2010/0118062 | A1* | 5/2010 | Mori et al. | 345/690 |
| 2010/0283913 | A1* | 11/2010 | Caballero | 348/730 |

FOREIGN PATENT DOCUMENTS

| | | | |
|---|---|---|---|
| GB | 2403096 | A | 12/2004 |
| JP | 2003289368 | | 10/2003 |
| KR | 1020010056621 | A | 7/2001 |
| KR | 10-0677223 | | 1/2007 |

OTHER PUBLICATIONS

Display Device, Display Device Drive Method, and Computer Program, Mori et.al. (WO/2008/143130).*

(Continued)

*Primary Examiner* — Lun-Yi Lao
*Assistant Examiner* — MD Saiful A Siddiqui
(74) *Attorney, Agent, or Firm* — Volentine & Whitt, PLLC

(57) ABSTRACT

An apparatus controls a backlight of a display panel of a camera system. The apparatus includes a sub-pixel extracting unit, an ambient light luminance calculating unit, and a backlight controller. The sub-pixel extracting unit extracts sub-pixel luminance values from image data, where the image data is indicative of a current image frame defined by a plurality of pixels, and where each of the pixels includes a plurality of sub-pixels. The ambient light luminance calculating unit calculates an ambient light luminance value of the current image frame from the sub-pixel luminance values extracted by the sub-pixel extracting unit. The backlight controller which generates a backlight control signal based on a comparison between the calculated ambient light luminance value of the current image frame and an ambient light luminance value of a previous image frame.

9 Claims, 5 Drawing Sheets

OTHER PUBLICATIONS

European Search Report in Related European Application No. 10168145.0 Dated Jan. 31, 2012.

Samsung: "CMOS Image Sensor(CIS) Image Signal Processor", 20021101, No. Revision 0.0, Nov. 1, 2002, pp. 1-35, XP007921377.

Samsung: "CMOS Image Sensor with Image Signal Processing", 20020429, vol. v1.0, No. Rev 2.0, Apr. 29, 2002, p. 1-64, XP007921368.

European Office Action Dated Jan. 4, 2013.

* cited by examiner

FIG. 4A

400

| | | | |
|---|---|---|---|
| 1 (0) | 2 (1) | 3 (1) | 4 (0) |
| 5 (1) | 6 (3) | 7 (5) | 8 (2) |
| 9 (1) | 10 (1) | 11 (4) | 12 (1) |
| 13 (0) | 14 (1) | 15 (0) | 16 (1) |

FIG. 4B

400

| | | | |
|---|---|---|---|
| 1 (0) | 2 (1) | 3 (2) | 4 (0) |
| 5 (1) | 6 (6) | 7 (8) | 8 (2) |
| 9 (0) | 10 (5) | 11 (8) | 12 (1) |
| 13 (0) | 14 (0) | 15 (0) | 16 (1) |

APPARATUS FOR AND METHOD OF CONTROLLING BACKLIGHT OF DISPLAY PANEL IN CAMERA SYSTEM

CROSS-REFERENCE TO RELATED APPLICATIONS

A claim of priority is made to Korean Patent Application No. 10-2009-0063601, filed Jul. 13, 2009, in the Korean Intellectual Property Office, the disclosure of which is incorporated herein in its entirety by reference.

BACKGROUND

The inventive concepts relates to an apparatus for and method of controlling a backlight of a display panel in a camera system, and more particularly, to an apparatus for and method of controlling a backlight of a display panel in a camera system by utilizing image data luminance values of sub-pixels.

An ambient light detector of a camera system is a monochromatic sensor having a very low resolution and is a physically separate unit from a camera module of the camera system. For example, in certain brand-name laptop computers, a camera or a web-cam is installed in an upper end of a liquid crystal display (LCD) panel, while a separate ambient light detector is installed in a lower end of the LCD panel.

SUMMARY

According to an aspect of the inventive concept, an apparatus is provided for controlling a backlight of a display panel of a camera system. The apparatus includes a sub-pixel extracting unit, an ambient light luminance calculating unit, and a backlight controller. The sub-pixel extracting unit extracts sub-pixel luminance values from image data, where the image data is indicative of a current image frame defined by a plurality of pixels, and where each of the pixels includes a plurality of sub-pixels. The ambient light luminance calculating unit calculates an ambient light luminance value of the current image frame from the sub-pixel luminance values extracted by the sub-pixel extracting unit. The backlight controller which generates a backlight control signal based on a comparison between the calculated ambient light luminance value of the current image frame and an ambient light luminance value of a previous image frame.

According to another aspect of the inventive concept, a method is provided for controlling intensity level of a backlight of a display panel of a camera system. The method includes extracting sub-pixel luminance values from image data, where the image data is indicative of a current image frame defined by a plurality of pixels, and where each of the pixels include a plurality of sub-pixels. The method further includes calculating an ambient light luminance value of the current image frame from the extracted sub-pixel luminance values, and generating a backlight control signal based on a comparison between the calculated ambient light luminance value of the current image frame and an ambient light luminance value of a previous image frame.

BRIEF DESCRIPTION OF THE DRAWINGS

Exemplary embodiments of the inventive concepts will be more clearly understood from the detailed description that follows, taken in conjunction with the accompanying drawings, in which:

FIG. 4A is a diagram of a pixel arrangement of a current scene according to an exemplary embodiment;

FIG. 4B is a diagram of a pixel arrangement of a previous scene according to an exemplary embodiment.

DETAILED DESCRIPTION OF THE EMBODIMENTS

Figure 1:
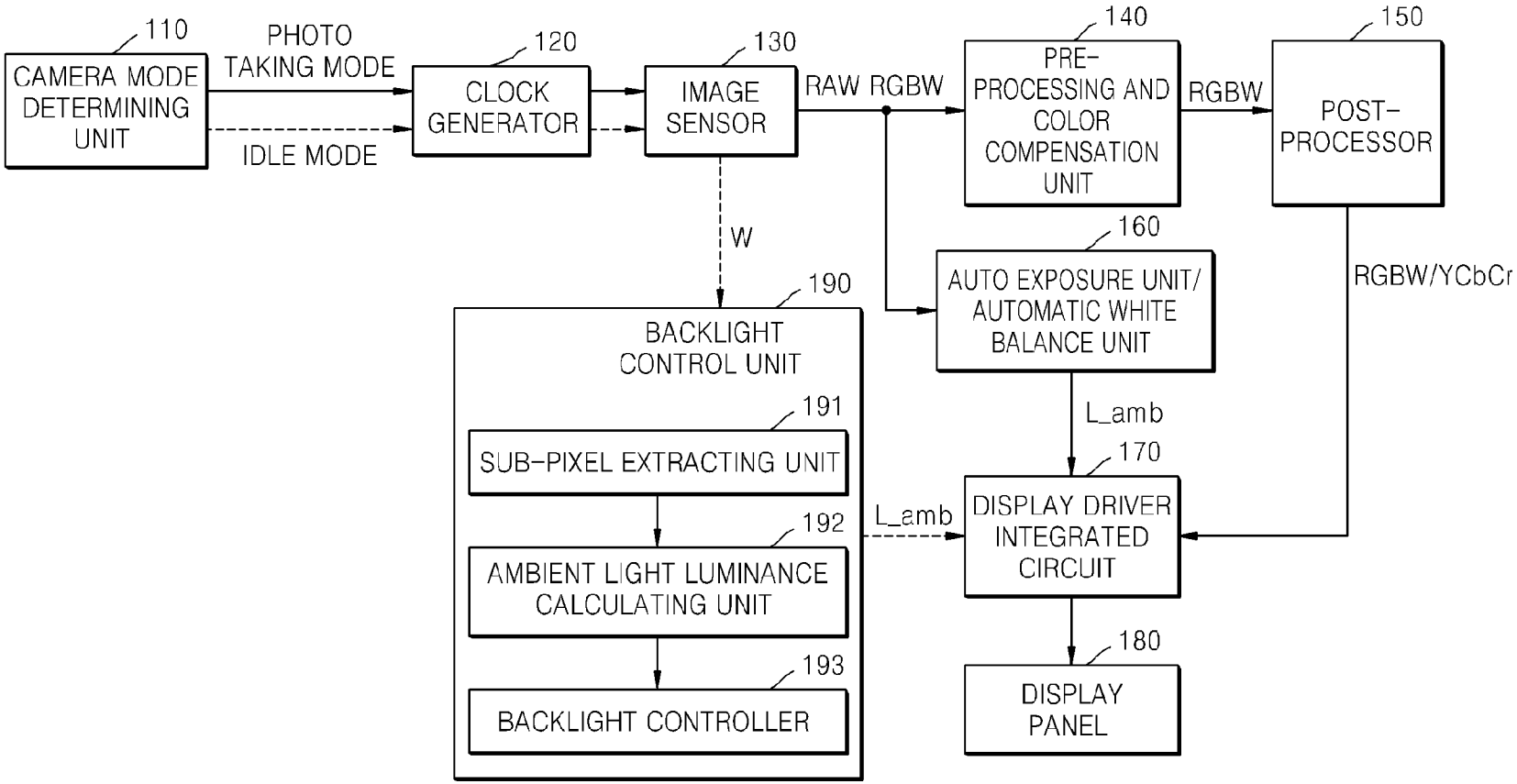
FIG. 1 is a block diagram of a camera system according to an exemplary embodiment.

The accompanying drawings illustrate exemplary embodiments of the inventive concepts and are reference to gain a sufficient understanding of the inventive concepts, the merits thereof, and the objectives accomplished by the implementation of the inventive concepts. Like reference numerals in the drawings denote like elements.

Hereinafter, the inventive concepts will be described in detail by way of exemplary and non-limiting embodiments of the inventive concepts.

FIG. 1 is a block diagram of a camera system according to an exemplary embodiment.

Referring to FIG. 1, the camera system includes a camera mode determining unit 110, a clock generator 120, an image sensor 130, a pre-processing and color compensation unit 140, a post-processor 150, an auto exposure unit/automatic white balance unit 160, a display driver integrated circuit (IC) (DDI) 170, a display panel 180, and a backlight control unit 190.

The backlight control unit 190 includes a sub-pixel extracting unit 191, an ambient light luminance calculating unit 192, and a backlight controller 193.

The camera system is of the type which includes an embedded display panel, and non-limiting examples include a digital camera, a digital camcorder, a webcam, a mobile telephone, a mobile PDA (personal data assistant), and the like.

Non-limiting examples of the display panel 180 include an organic light emitting diode (OLED) display (or organic electroluminescence display), a field emission display (FED), a liquid crystal display (LCD), a plasma display panel (PDP), and the like. In the example of the present embodiment, display panel 180 is an LCD. Further, although not shown, a backlight may be included in the display panel 180. The backlight illuminates from the back of the display panel 180 and is used to increase readability of the display panel 180. Non-limiting examples of the backlight include a cold cathode fluorescent lamp (CCFL), an external electrode fluorescent lamp (EEFL), a luminescent diode (LED), a flat fluorescent lamp (FFL), and the like.

The camera system is configured to operate in either a photo-taking mode or an idle mode, and the camera mode determining unit 110 determines whether the camera is operating in the photo-taking mode or the idle mode. In FIG. 1, the solid arrows represent the transfer of signals/data of the camera system in the photo-taking mode, while the dashed arrows represent the transfer of signals/data of the camera system in the idle mode.

The image sensor 130 is a device that captures an image and includes, for example, a semiconductor structure with optical-to-electrical properties, and optical lenses for isolating incident light of different wavelengths. Non-limiting examples of the image sensor 130 include a charge coupled device (CCD) image sensor or a complementary metal oxide semiconductor (CMOS) image sensor. The image sensor 130 outputs image data indicative of a light intensity or luminance values of a pixel array, and each pixel array denotes a captured image scene (referred to herein as an "image frame"), such as a snapshot in the case of a captured still image, or a frame in the case of a captured moving image. In the example of the present embodiment, each pixel includes red (R), green (G), blue (B), and white (W) sub-pixels. However, the inventive concepts are not limited thereto and any of a variety of different pixel arrangements may instead be adopted.

The image sensor 130 operates according to a timing signal provided by the clock generator 120 of FIG. 1. For example, the image sensor 130 may be controlled to receive (or detect) incident light for a period of time corresponding to the timing signal.

The operation of the camera system in the photo-taking mode will now be described. In the photo-taking mode, the camera system is turned on and is operable to record a video or capture an image.

In the photo-taking mode, the pre-processing and color compensation unit 140 receives the image data from the image sensor 130, for example, a RAW RGBW signal, as raw data, performs a color interpolation with respect to the image data, performs pre-processing on the color interpolated image data, and outputs a resultant preprocessed RGBW signal. The postprocessor 150 receives the preprocessed RGBW signal and outputs a post-processed RGBW signal, a luminance component Y, and chrominance components $C_b$ and $C_r$ to the DDI 170. The signal processing executed by the pre-processing and color compensation unit 140 and postprocessor 150 are well-known by those skilled in the art, and thus a detailed description thereof is omitted here for the sake of brevity.

The DDI 170 drives the display panel 180 according to the post-processed RGBW/YCbCr signal so as to display a corresponding image.

In addition, when the camera system is in the photo-taking mode, the auto exposure unit/automatic white balance unit 160 calculates an ambient light luminance value L_amb, and the DDI 170 uses the ambient light luminance L_amb to control intensity level of the backlight of the display panel 180.

The operation of the camera system in the idle mode will now be described. In the idle mode, the camera system or the image sensor 130 is in a standby state or an idle state. In this state, the camera system is not operative to capture and process an image. In the example of the present embodiment, the pre-processing and color compensation unit 140, the post-processor 150, and the auto exposure unit/automatic white balance unit 160 do not operate in the idle mode.

However, the image sensor 130 remains operative, preferably in a reduced capacity, in the idle mode. For example, in the idle mode, the image sensor 130 may be operative to automatically detect one frame from a scene per second.

The backlight control unit 190 receives a sub-pixel signal W from among RGBW sub-pixel signals of the image sensor 130.

In particular, the sub-pixel extracting unit 191 extracts luminance values of a portion of predetermined sub-pixels from image data indicative of luminance values the RGBW sub-pixels of an image frame captured by the image sensor 130. For example, the sub-pixel extracting unit 191 extracts luminance values of a portion of the green (G) sub-pixels or a portion of the white (W) sub-pixels contained in a captured image frame. When there are no white sub-pixels, e.g., when the predetermined sub-pixel signal only includes RGB sub-pixels, the sub-pixel extracting unit 191 may extract a part of predetermined sub-pixels from the RGB sub-pixels. In the present embodiment, the sub-pixel extracting unit 191 extracts a portion of white sub-pixels. Since the idle mode does not need high accuracy, the sub-pixel extracting unit 191 does not need to read all of the white sub-pixels in order to measure an ambient light level. Also, the clock generator 120 may output a clock signal having a reduced frequency when compared to that of the photo-taking mode. Thus, a read-out frequency may be reduced, thereby reducing power consumption of the camera system. The number of white sub-pixels extracted by the sub-pixel extracting unit 191 may be experimentally determined. Also, the inventive concepts are not limited to RGBW sub-pixels and may be applied to a different pixel structure.

The ambient light luminance calculating unit 192 uses the extracted luminance values of the white sub-pixels to calculate an ambient light luminance value. The calculation of the ambient light luminance value using predetermined sub-pixels is well known and thus detailed description thereof is not repeated here. Thereafter, the ambient light luminance calculating unit 192 transmits the calculated ambient light luminance value to the backlight controller 193.

The backlight controller 193 compares the ambient light luminance value transmitted from the ambient light luminance calculating unit 192 with an ambient light luminance value of previous image data stored in a predetermined buffer. The backlight controller 193 generates a backlight control signal according to a comparison result and transmits the backlight control signal to the DDI 170. The DDI 170 controls intensity level of the backlight of the display panel 180 according to the backlight control signal. For example, if ambient light is bright, the DDI 170 increases the intensity level of the backlight, and if the ambient light is dark, the DDI 170 reduces the intensity level of the backlight.

Figure 2:
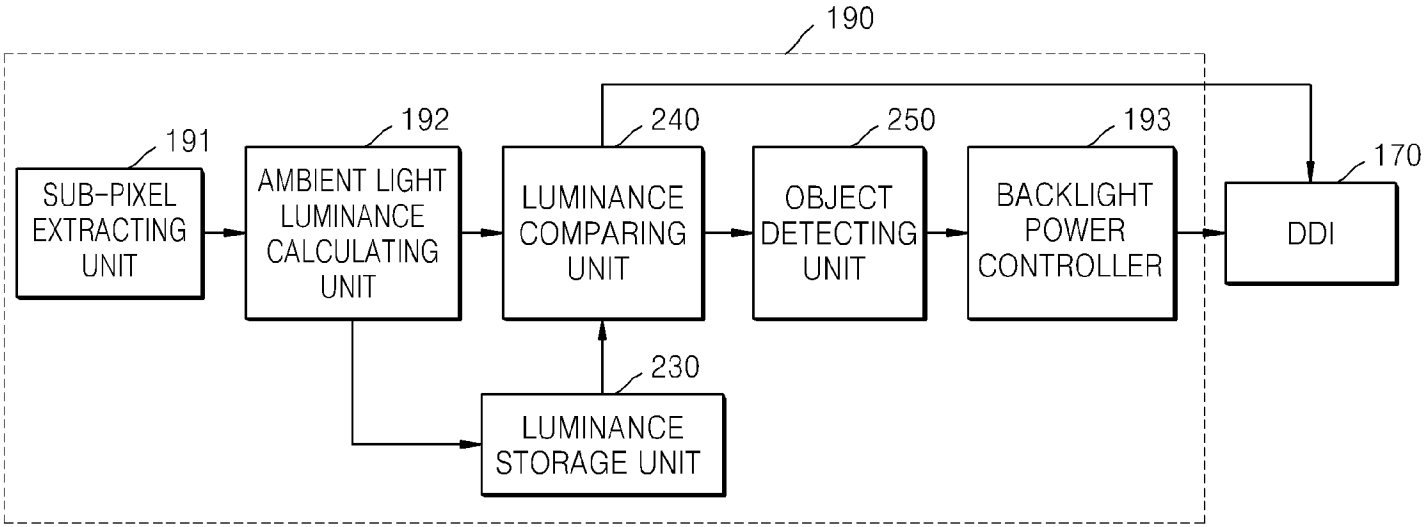
FIG. 2 is a block diagram of a backlight control device in an idle mode according to an exemplary embodiment.

FIG. 2 is a more detailed diagram of the backlight control device 190 illustrated in FIG. 1, which is operative in an idle mode to control the DDI 170 according to an exemplary embodiment.

Referring to FIG. 2, the backlight control device 190 of this example includes a sub-pixel extracting unit 191, an ambient light luminance calculating unit 192, a luminance storage unit 230, a luminance comparing unit 240, an object detecting unit 250, and a backlight power controller 193.

Figure 3:
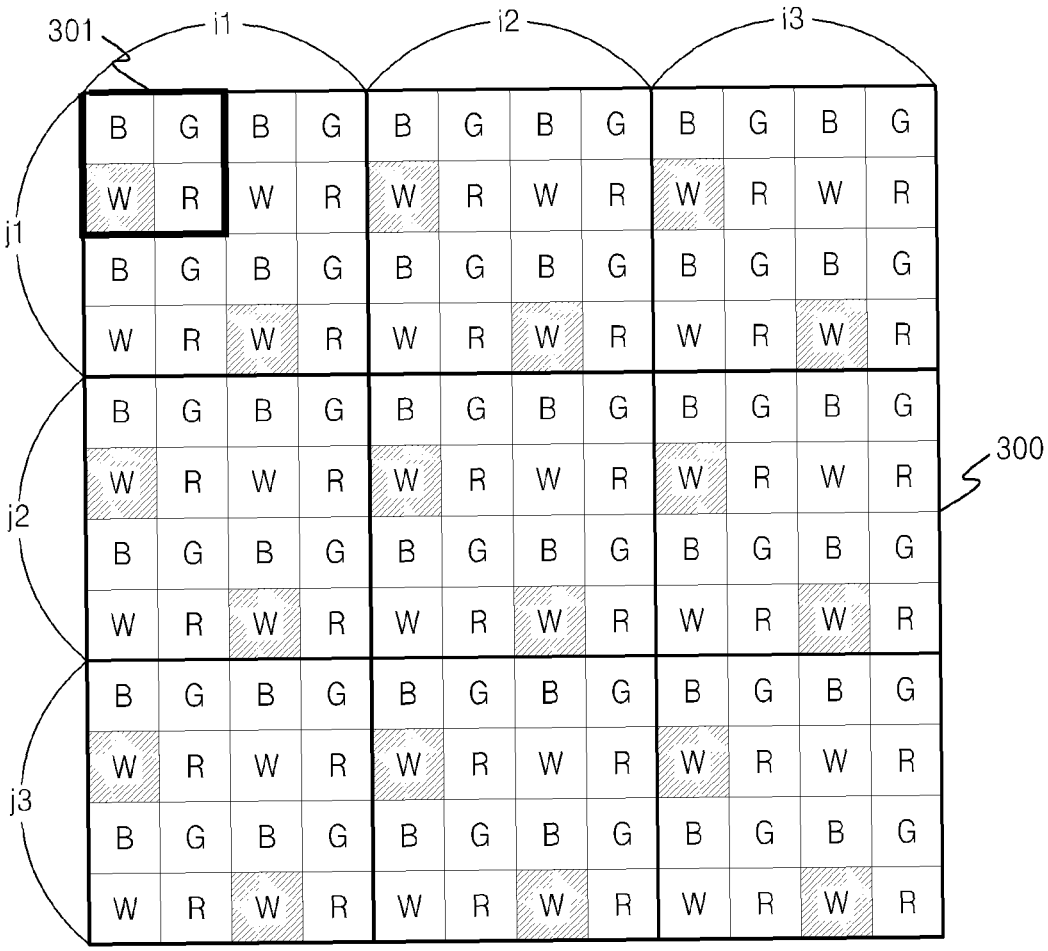
FIG. 3 is a diagram of a pixel arrangement of image data according to an exemplary embodiment.

In the present embodiment, the sub-pixel extracting unit 191 divides a scene or frame of pixels received from an image sensor into a plurality of predetermined regions. For example, in the present embodiment, each region includes a plurality of RGBW pixels, and the sub-pixel extracting unit 191 extracts a portion (less than all) of white sub-pixels of the RGBW pixels contained each region. For example, if each region contains "n" pixels, and the scene contains i*j regions (where i and j are integers greater than 1), the number of white sub-pixels extracted by the sub-pixel extracting unit 191 is less than the product n*i*j. FIG. 3 is discussed next which presents an example in which n=4, i=3, and j=3, and in which the number of extracted white sub-pixels is (n*i*j)/2.

FIG. 3 is a diagram showing an example of the pixel arrangement represented by image data transmitted from the image sensor 130 to the backlight control unit 190 according to an exemplary embodiment.

Referring to FIG. 3, a scene (or frame) 300 is divided into 3×3 (=9) pixel regions i1*ji*~i3*j*3, where each pixel region includes four (4) pixels. In this example, each pixel (e.g., pixel 301) is an RGBW pixel, i.e., each pixel includes a red sub-pixel R, a green sub-pixel G, a blue sub-pixel B, and a white sub-pixel W. In the example of this embodiment, the sub-pixel extracting unit 191 extracts two white sub-pixels (indicated by shading) from each pixel region i1$ji$~i3$j$3. However, the inventive concepts are not limited by number of sub-pixels extracted by the sub-pixel extracting unit 191, but in the exemplary embodiments less than all of the white sub-pixels are extracted by the sub-pixel extracting unit 191. Also, the inventive concepts are not limited to the extraction of the white sub-pixels, i.e., other color sub-pixels may be extracted instead.

The ambient light luminance calculating unit 192 uses respective luminance values of the white sub-pixels extracted by the sub-pixel extracting unit 191 to calculate an ambient light luminance value of each region. Also, the ambient light luminance calculating unit 192 uses the thus calculated ambient light luminance value of each region to calculate an average ambient light luminance value of all the regions (e.g., of the entire scene 300 of FIG. 3). This is explained in below with reference to FIG. 4A.

FIG. 4A is a diagram of a pixel arrangement of a current scene (i.e., image frame) 400 according to an exemplary embodiment.

Referring to FIG. 4A, the current scene 400 is divided into i*j (i=4, j=4) regions, with each region including a plurality of pixels. The numbers in brackets denote an average ambient light luminance value which corresponds to an average of luminance values of white sub-pixels extracted within each region. However, the embodiment is not so limited. For example, the numbers in brackets may instead denote an ambient light luminance value which corresponds to a sum of luminance values of white sub-pixels extracted within each region.

In the example of the present embodiment, the average ambient light luminance value of the scene 400 is the average value of the respective ambient light luminance values of the regions. That is, the average ambient light luminance value may be obtained according to Equation 1:

$$\sum_{i=1}^{4}\sum_{j=1}^{4} L_{ij} \div (i \times j) \qquad \text{Equation 1}$$

where i denotes the number of rows of regions, j denotes the number of columns of regions, and L denotes a luminance value of each region. Thus, in the example of FIG. 4A, the average ambient light luminance value of the current scene 400 is (0+1+2+0+1+6+8+2+0+5+8+1+0+0+0+1)/16=35/16, which is about 2.19.

Returning to FIG. 2, the luminance storage unit 230 stores the ambient light luminance value of each region of a previous scene, as well as the ambient light luminance value of each region of the current scene 400.

The luminance comparing unit 240 compares the ambient light luminance value of each region of the current scene 400 with the ambient light luminance value of each region of the previous scene stored in the luminance storage unit 230. In the example of the present embodiment, the comparison is relative to a predetermined threshold.

For example, a value representing the change in ambient light luminance values between the previous scene and the current scene 400 may be obtained according to Equation 2:

$$\sum_{i=1}^{4}\sum_{j=1}^{4} (L_{ij} - L'_{ij}) \qquad \text{Equation 2}$$

where $L'_{ij}$ denotes the ambient light luminance value of a region of the previous scene.

Application of Equation 2 is explained in more detail with reference to FIGS. 4A and 4B. FIG. 4A is a diagram of a current scene 400 as described above. FIG. 4B is a diagram of a pixel arrangement of a corresponding previous scene 400 according to an exemplary embodiment.

Referring to Equation 2 and the numerical examples shown in FIGS. 4A and 4B, the change in ambient light luminance values between the previous scene and the current scene 400 is (0+0+1+0+0+3+3+0−1+4+4+0+0−1+0+0)=13. In the embodiment, this number is compared with a predetermined threshold is set according to operating characteristics of the display panel and/or through experimentation. If the change the ambient light luminance values between the previous scene and the current scene 400 is below the threshold, there is no change in the intensity level of the backlight.

If the ambient light luminance values of a previous scene are not stored in the luminance storage unit 230, the luminance comparing unit 240 transmits the average ambient light luminance value of the current scene 400 to a DDI 170. The DDI 170 uses the average ambient light luminance value to calculate the intensity level of the backlight of the display panel.

If the change between the ambient light luminance values between the previous scene and the current scene 400 is greater than the threshold, the object detecting unit 250 detects for the existence of an object. The object detecting unit 250 may detect a change in the existence of an object, i.e. the object appears in the previous scene and does not appear in the current scene 400 (for example, a user that goes beyond the field of vision of a camera may be the object) or the object does not appear in the previous scene and appears in the current scene (for example, the user that enters the field of vision of the camera may be the object). For example, the changes in the ambient light luminance values of the previous scene and of the current scene 400 of regions 6, 7, 10, and 11 are greater than in other neighboring regions. This means that an object appears in the regions 6, 7, 10, and 11 and then does not appear, or the object does not appear in the regions 6, 7, 10, and 11 and then appears. If the changes in the ambient light luminance values between the previous scene and the current scene 400 are greater in predetermined neighboring regions than in other neighboring regions, whether the object exists or not may be detected. However, the inventive concepts are not limited to using changes in luminance values in specific regions, and instead, for example, the existence of an object may be detected as a sum of changes in ambient light luminance values of all regions.

The backlight power controller 193 generates a signal for turning off the backlight when the object detecting unit 250 detects that an object does not exist, and generates a signal for turning on the backlight when the object detecting unit 250 detects that the object exists. In more detail, whether the object exists is determined according to a previous status of the backlight. When the object detecting unit 250 detects that the object exists or does not exist according to changes in ambient light luminance values, i.e., when the changes in the ambient luminance values of the previous scene and of the current scene 400 are greater in predetermined neighboring regions than in other neighboring regions, whether the object exists is determined according to a previous power status of the backlight. When the backlight is on, it is determined that the object appears and then disappears and thus the backlight power controller 193 generates the signal for turning off the backlight. When the backlight is off, it is determined that the object does not appear and then appears and thus the backlight power controller 193 generates the signal for turning on the backlight. However, even if the change in the ambient light luminance value is greater than the threshold, if the object detecting unit 250 does not detect that the object exists or does not exist, there is no change in the status of the backlight. The backlight power controller 193 transmits the average ambient light luminance value of the current scene 400 to the DDI 170. The DDI 170 uses the average ambient light luminance value to control the intensity level of the backlight.

The DDI 170 turns off the backlight when the DDI 170 receives the signal for turning off the backlight generated by the backlight power controller 193. The DDI 170 turns on the backlight when the DDI 170 receives the signal for turning on the backlight.

The backlight control device may be implemented in an image sensor or a DDI.

Figure 5:
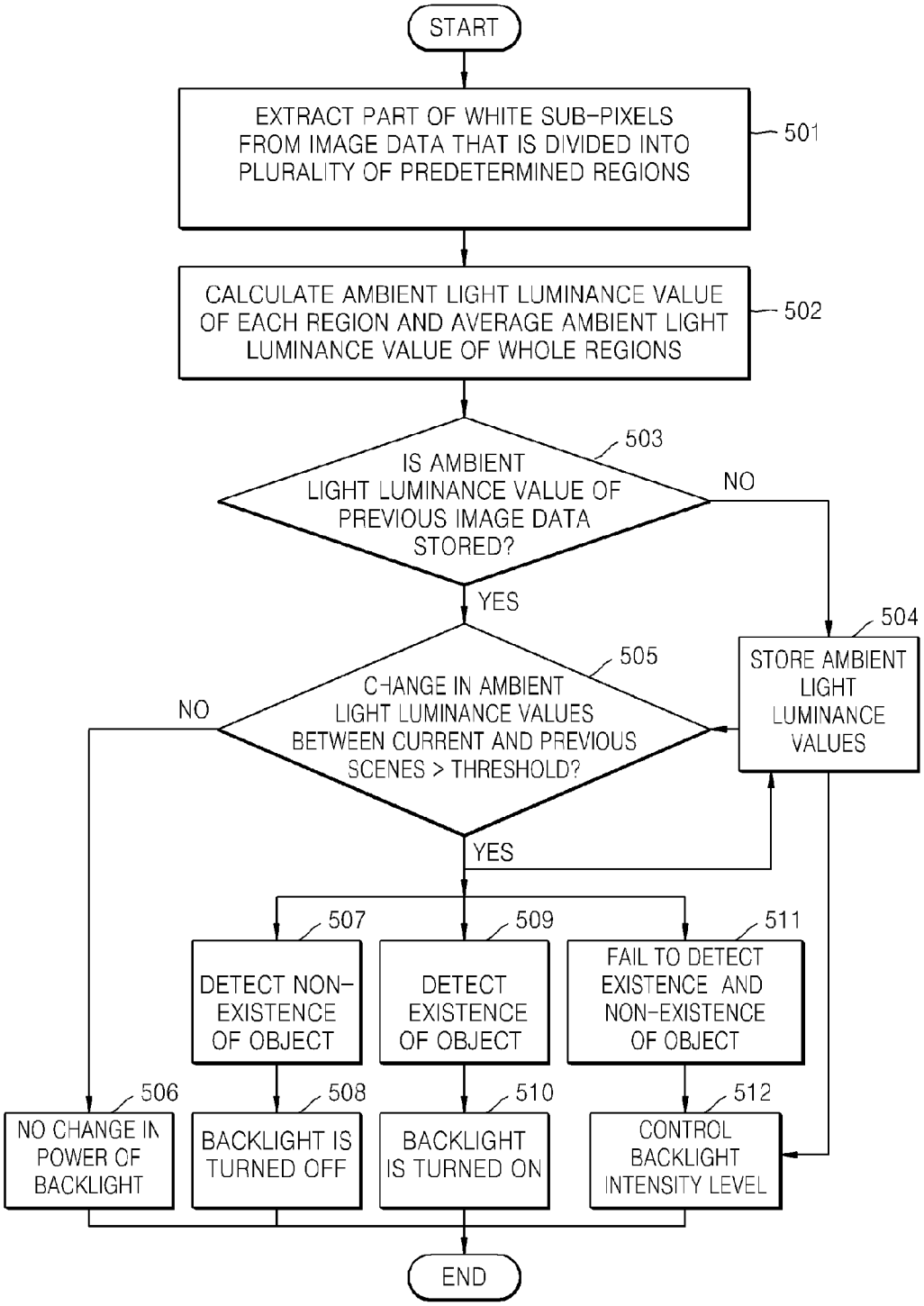
FIG. 5 is a flowchart illustrating a method of controlling a backlight of a display panel in an idle mode according to an exemplary embodiment.

FIG. 5 is a flowchart illustrating a method of controlling intensity level of a backlight of a display panel in an idle mode according to an exemplary embodiment.

Referring to FIG. 5, the luminance values of a portion of predetermined sub-pixels are extracted from image data that is divided into a plurality of predetermined regions (operation 501). More precisely, luminance values of predetermined sub-pixels among RGBW sub-pixels are extracted from image data generated by an image sensor of a camera system. For example, a portion of green sub-pixels may be extracted from the RGBW sub-pixels or a portion of white sub-pixels may be extracted from the RGBW sub-pixels. If there are no white sub-pixels, e.g. if only RGB sub-pixels are received, a portion of predetermined sub-pixels may be extracted from the RGB sub-pixels. In the present embodiment, the luminance values of a portion of white sub-pixels are extracted from the RGBW sub-pixels. For example, if the image data is divided into i*j (i and j are integers greater than 1) regions, the number of the extracted white pixels is less than a number obtained by multiplying i by j. As discussed previously, the number of white sub-pixels extracted may be experimentally determined.

The extracted portion of white sub-pixels is used to calculate an ambient light luminance value of each region and an average ambient light luminance value of all the regions (operation 502).

It is determined whether ambient light luminance values of previous image data are stored (operation 503). If it is determined that the ambient light luminance values of previous image data are stored, operation 505 is performed. If it is determined that the ambient light luminance values of previous image data are not stored, operation 504 is performed.

If it is determined that the ambient light luminance values of previous image data are not stored, the ambient light luminance value of each region and the average ambient light luminance value of all the regions are stored (operation 504). Thereafter, the intensity level of the backlight is determined according to the average ambient light luminance value of all the regions (operation 512).

If it is determined that the ambient light luminance values of previous image data are stored, the ambient light luminance value of each region is compared to an ambient light luminance value of each region of previous image data (operation 505). In more detail, a change between the ambient light luminance values of the previous image data and of current image data is compared to a predetermined threshold. The predetermined threshold is determined according to the characteristics of a display panel of a manufacturing company or according to experimentation. If the change between the sums of the ambient light luminance values of the previous image data and of the current image data is below the threshold, operation 506 is performed. If the change between the sums of ambient light luminance values of the previous image data and of the current image data is greater than the threshold, operation 507, 509, or 511 is performed.

If the change between the sums of the ambient light luminance values of the previous image data and of the current image data is below the threshold, there is no change in the intensity level of the backlight (operation 506).

If the change between the sums of the ambient light luminance values of the previous image data and of the current image data is greater than the threshold, whether an object exists is determined. In more detail, if the change between the sums of the ambient light luminance values of the previous image data and of the current image data is greater than the threshold, whether the object exists or not may be detected, i.e., the object appears in the previous image data and does not appear in the current image data (for example, a user that goes beyond the field of vision of a camera may be the object: operation 507) or the object does not appear in the previous image data and appears in the current image data (for example, the user that enters the field of vision of the camera may be the object: operation 509).

For example, if the changes between the ambient light luminance values of the previous image data and of the current image data are greater in predetermined regions than in other neighboring regions, the object appears in the predetermined regions and then does not appear, or the object does not appear in the predetermined regions and then appears. If the changes between the ambient light luminance values of the previous image data and of the current image data are greater in predetermined neighboring regions than in other neighboring regions, whether the object exists or not may be detected. The inventive concepts are not limited to changes between ambient light luminance values of the previous image data and of the current image data in a specific region and whether the object exists or not may be detected as changes between the ambient light luminance values of the previous image data and of the current image data of all the regions.

The backlight is turned off if it is detected that the object does not exist (operation 508). The backlight is turned on if it is detected that the object exists (operation 510). In more detail, whether the object exists is determined according to a previous status of the backlight. When it is detected that the object exists or does not exist due to changes in the ambient light luminance value, i.e., when the changes in the luminance values of the previous image data and of the current image data are greater in predetermined neighboring regions than in other neighboring regions, whether the object exists is determined according to a previous power status of the backlight. When the backlight is on, it is determined that the object appears and then does not appear and thus the backlight is turned off. When the backlight is off, it is determined that the object does not appear and then appears and thus the backlight is turned on. Although, even if the changes in the ambient light luminance values of the previous image data and of the current image data is greater than the threshold, if it is not detected that the object exists or does not exist (operation 511), there is no change in the intensity level of the backlight. The intensity level of the backlight is controlled based on the average ambient light luminance value of the current image data.

While the inventive concept has been particularly shown and described with reference to exemplary embodiments thereof, it will be understood that various changes in form and details may be made therein without departing from the spirit and scope of the following claims.

What is claimed is:

1. An apparatus for controlling a backlight of a display panel of a camera system, the apparatus comprising:

a sub-pixel extracting unit which extracts sub-pixel luminance values from image data, wherein the image data is indicative of a current image frame defined by a plurality of pixels, and wherein each of the pixels includes a plurality of sub-pixels;

an ambient light luminance calculating unit which calculates an ambient light luminance value of the current image frame from the sub-pixel luminance values extracted by the sub-pixel extracting unit; and a backlight controller which generates a backlight control signal based on a comparison between the calculated ambient light luminance value of the current image frame and an ambient light luminance value of a previous image frame, wherein the sub-pixel extracting unit divides the image data into a plurality of regions each including a plurality of pixels, and extracts the luminance values of a portion of the sub-pixels of a same color contained in each of the plurality of regions, wherein the plurality of pixels each include a plurality of different colored sub-pixels.

2. The apparatus of claim 1, wherein the different colored sub-pixels are red (R), green (G), blue (B), and white (W) sub-pixels, and wherein the extracted luminance values are for the white (W) sub-pixels.

3. The apparatus of claim 1, wherein the ambient light luminance calculating unit calculates an ambient light luminance value of each region based on the extracted luminance values of a portion of the sub-pixels of the same color contained in each region, and calculates an average ambient light luminance value based on the ambient light luminance values calculated for each region.

4. The apparatus of claim 3, wherein the backlight controller comprises:

a luminance comparing unit which compares the ambient light luminance value of each region with an ambient light luminance value of each region of the previous image frame;

an object detecting unit which detects whether an object exists based on a comparison result of the luminance comparing unit; and a backlight power controller which generates a signal for on/off control of the backlight of the display panel according to the detection of whether the object exists.

5. The apparatus of claim 4, wherein the luminance comparing unit compares a change between the ambient light luminance values of the previous image data and of the current image data with a predetermined threshold, wherein the object detecting unit detects whether the object exists if a change between the sums of the ambient light luminance values of the previous image data and of the current image data is greater than the predetermined threshold.

6. The apparatus of claim 5, wherein the backlight power controller generates a signal for turning off the backlight when the object detecting unit detects that the object does not exist, and generates a signal for turning on the backlight when the object detecting unit detects that the object exists, wherein the apparatus further comprises a display driver integrated circuit (DDI) which turns on or off the backlight of the display panel according to the signals generated by the backlight power controller.

7. The apparatus of claim 1, wherein the sub-pixel extracting unit, the ambient light luminance calculating unit, and the backlight controller are implemented in an image sensor included in the camera system.

8. A method of controlling intensity level of a backlight of a display panel of a camera system, the method comprising:

extracting sub-pixel luminance values from image data, wherein the image data is indicative of a current image frame defined by a plurality of pixels, and wherein each of the pixels include a plurality of sub-pixels;

calculating an ambient light luminance value of the current image frame from the extracted sub-pixel luminance values; and generating a backlight control signal based on a comparison between the calculated ambient light luminance value of the current image frame and an ambient light luminance value of a previous image frame, wherein said extracting comprises dividing the image data into a plurality of regions each including a plurality of pixels, and extracting the luminance values of a portion of the sub-pixels of a same color contained in each of the plurality of regions, wherein the plurality of pixels each include a plurality of different colored sub-pixels.

9. The method of claim 8, wherein the different colored sub-pixels are red (R), green (G), blue (B), and white (W) sub-pixels, and wherein the extracted luminance values are for the white (W) sub-pixels.

* * * * *